US006095613A

United States Patent [19]

Ostrander et al.

[11] Patent Number: 6,095,613

[45] Date of Patent: Aug. 1, 2000

[54] MULTI-PURPOSE CHILD SAFETY HARNESS

[76] Inventors: Christine Marie Ostrander, 12545 McGee Dr., Whittier, Calif. 90606; Keith Raymond Southworth, 7291 Kirby Way, Stanton, Calif. 90680

[21] Appl. No.: 09/274,071

[22] Filed: Mar. 22, 1999

[51] Int. Cl.[7] ..... A47C 31/00

[52] U.S. Cl. ..... 297/467; 297/484; 297/485

[58] Field of Search ..... 297/485, 484, 297/465, 467

[56] References Cited

U.S. PATENT DOCUMENTS

| | | | |
|---|---|---|---|
| 1,205,384 | 11/1916 | Peck . | |
| 2,451,007 | 10/1948 | White . | |
| 3,604,750 | 9/1971 | Doering . | |
| 3,713,692 | 1/1973 | McCracken et al. . | |
| 3,780,919 | 12/1973 | Hansson . | |
| 3,871,562 | 3/1975 | Grenier . | |
| 3,954,280 | 5/1976 | Roberts et al. | 297/484 |
| 4,009,808 | 3/1977 | Sharp . | |
| 4,037,764 | 7/1977 | Almosnino . | |
| 4,050,737 | 9/1977 | Jordan . | |
| 4,149,687 | 4/1979 | Nunemacher . | |
| 4,234,229 | 11/1980 | Arnold . | |
| 4,235,474 | 11/1980 | Rosenberg . | |
| 4,271,998 | 6/1981 | Ruggiano . | |
| 4,428,514 | 1/1984 | Elf . | |
| 4,676,554 | 6/1987 | Harlick et al. . | |
| 4,702,523 | 10/1987 | Schrader et al. . | |
| 4,861,109 | 8/1989 | Leach . | |
| 4,881,780 | 11/1989 | Barnes . | |
| 4,927,211 | 5/1990 | Bolcerek | 297/484 |
| 5,080,191 | 1/1992 | Sanchez | 297/465 |
| 5,119,767 | 6/1992 | Jimenez | 297/484 |
| 5,839,965 | 11/1998 | Mullins | 297/485 |

*Primary Examiner*—Anthony D. Barfield
*Attorney, Agent, or Firm*—Roger Au; Craig McLaughlin

[57] ABSTRACT

This multi-purpose child safety harness (10) is wearable and is used to support, hold, restrain, and protect a child (33) during a variety of the child's activities. In FIGS. 1–4, the harness (10) includes a torso band (11), a pair of shoulder straps (19, 21), an inner crotch strap (15), an outer crotch strap (16), and underarm securing straps (23, 25). The outer crotch strap is attached at the rear of the torso band and is used to secure the child to a seat (36) by looping the free end underneath the seat so as to attach it to the chest portion of the torso band thereby securing the child to the seat. The shoulder straps provide ejection protection of the child during swinging and other active pursuits. The securing straps are attached to the harness underneath each arm of the child and are terminated in means for securing the child to swing chains or ropes, and to various types of chairs, shopping carts, strollers, or other fixtures desired to safely retain the child. A stow ring (27) is attached to the rear of the torso band for stowage of ends of the securing straps and or for the attachment of a proximity tether line. An adjustable waist belt (13*a–c*) at the middle of the band allows for body size adjustments. At the center of the chest portion of the band is a storage pocket (12).

17 Claims, 4 Drawing Sheets

MULTI-PURPOSE CHILD SAFETY HARNESS

CROSS REFERENCES TO RELATED APPLICATIONS

Not applicable.

BACKGROUND

1. Field of the Invention

This invention relates to safety harnesses, specifically to an improved multi-purpose device for a child.

2. Description of Prior Art

Many child safety harnesses or retaining devices have previously been invented to protect a child from physical injury. These prior art harnesses were designed to provide protection in the form of restraint from the hazards of a particular activity. These prior art harnesses are of limited use and cannot be used to effectively restrain a child from the hazards of additional activities. Acquiring multiple safety harnesses or restraint devices to provide for the child's protection during various activities is both expensive and cumbersome.

The prior art is abundant with harnesses designed for the restraining of a child to a chair. Representatives of the prior art are the harnesses disclosed in U.S. Pat. No. to Peck (U.S. Pat. No. 1,205,384) White (U.S. Pat. No. 2,451,007), Doering (U.S. Pat. No. 3,604,750), McCracken et al (U.S. Pat. No. 3,713,692), Jordan (U.S. Pat. No. 4,050,373), Rosenberg (U.S. Pat. No. 4,235,474), Harlick et al (U.S. Pat. No. 4,676,554), Schrader et al (U.S. Pat. No. 4,702,523), and Leach (U.S. Pat. No. 4,861,109). All of these patents involved a diaper-like restraint harness with straps for attaching to a chair. Some harnesses also provided aesthetic shoulder straps. However, none of these harnesses can be easily adapted for other applications.

Other prior art involves carriers for transporting a child. The carriers can be attached to either the front or the back of an adult. Representatives of the prior art are the carriers disclosed in U.S. Pat. No. to Hansson (U.S. Pat. No. 3,780,919), Grenier (U.S. Pat. No. 3,871,562), Sharp (U.S. Pat. No. 4,009,808), Almosnino et al (U.S. Pat. No. 4,037,764), Nunemacher (U.S. Pat. No. 4,149,687), Arnold (U.S. Pat. No. 4,234,229), Ruggiano (U.S. Pat. No. 4,271,998), and Elf (U.S. Pat. No. 4,428,514) which also disclosed a secondary use to support a child on a chair. All of these patents are diaper-like devices that are made with only cloth or with cloth and a rigid frame. Some have straps retaining the shoulders of the child for extra protection. Additionally, these devices share similarity in design for they all mount either on an adult's back, on an adult's chest, or to the back of a chair. Adaptation of these designs to other applications is similarly limited.

The prior art for a swing safety harness is disclosed in the U.S. Pat. No. 4,881,780 to Barnes. This harness consists of a long panel of material, which extends from the chest area, travels under the child's crotch and up to the shoulder blade area. Unlike the instant invention, the child is placed on the swing seat before the harness is applied. Here, the intermediate section of the cloth panel is lifted to meet the bottom of the swing seat. The panel is thereafter secured to the seat by an attached elastic strap fastened over the seat. The child is then placed in a sitting position onto the swing seat over the fastener. The front and rear portions of the panel are upwardly brought to the chest and back of the child. Tie members at each of the ends of the panel are tied underneath the armpits of the child and to each of the two chains supporting the swing seat. The Barnes device is limited to swing seat applications, requires the attachment to the seat before the child is seated, is not meant to be wearable on the child's person, and the child must sit on the strap fastener which might not be comfortable. Furthermore, Barnes lacks shoulder straps to prevent the child from being ejected out the top of the restraint device in the event that the child is flipped either during swinging or stationary activity. Moreover, with Barnes, and unlike the instant invention, the child can escape out the sides of the panel or through the top of the device, as there is no containment at those locations. Wearability is also limited in that there is nothing preventing the Barnes device from slipping downward off the child.

The prior art is devoid of a harness or device specifically designed for multiple purposes and activities and thereby causes parents to acquire multiple safety harnesses and incur high expense in doing so. There is a pressing need, left unfulfilled by the prior art, for a multipurpose safety harness that will serve this purpose.

OBJECTS AND ADVANTAGES

Accordingly, several objects and advantages of this invention are to provide a single multi-purpose harness for the protection of a child during numerous daily activities. This harness can be used to hold, support, and restrain a child on a swing, on various types of chairs, inside a shopping cart, inside a stroller, and in some car and bicycle seats. Furthermore, this invention exhibits increased utility over the prior art as the preferred embodiment is wearable. Additionally, a proximity tether line can be attached to the preferred embodiment, providing further safety for the child in crowded or dangerous environments.

Still further objects and advantages will become apparent from a consideration of the ensuing description and accompanying drawings.

BRIEF DESCRIPTION OF THE DRAWINGS

All references to right or left are based on the perspective of the child while wearing the harness.

REFERENCE NUMERALS

Figure 1:
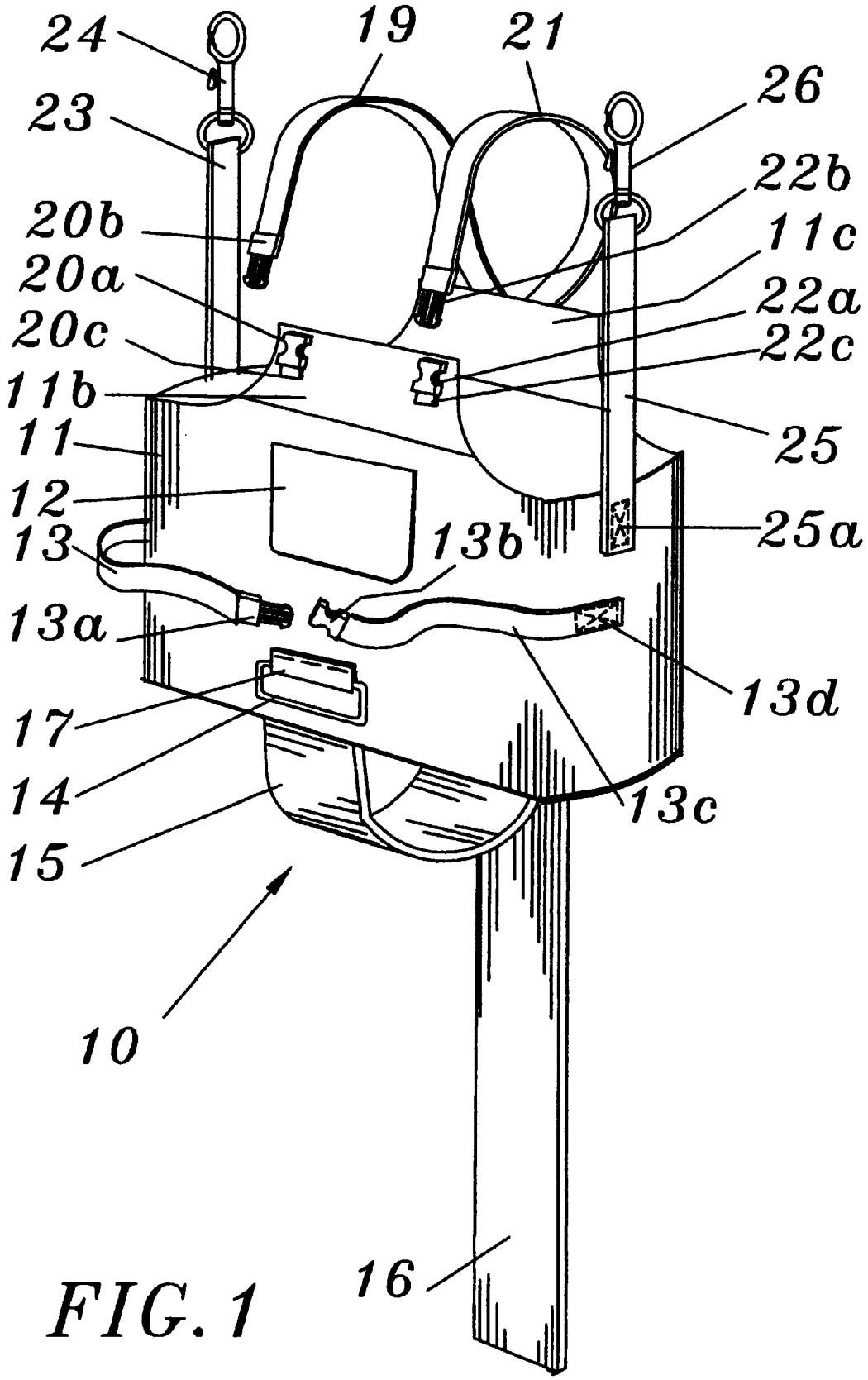
FIG. 1 is an angled prospective frontal and left side view of the multi-purpose child safety harness.
Figure 2:
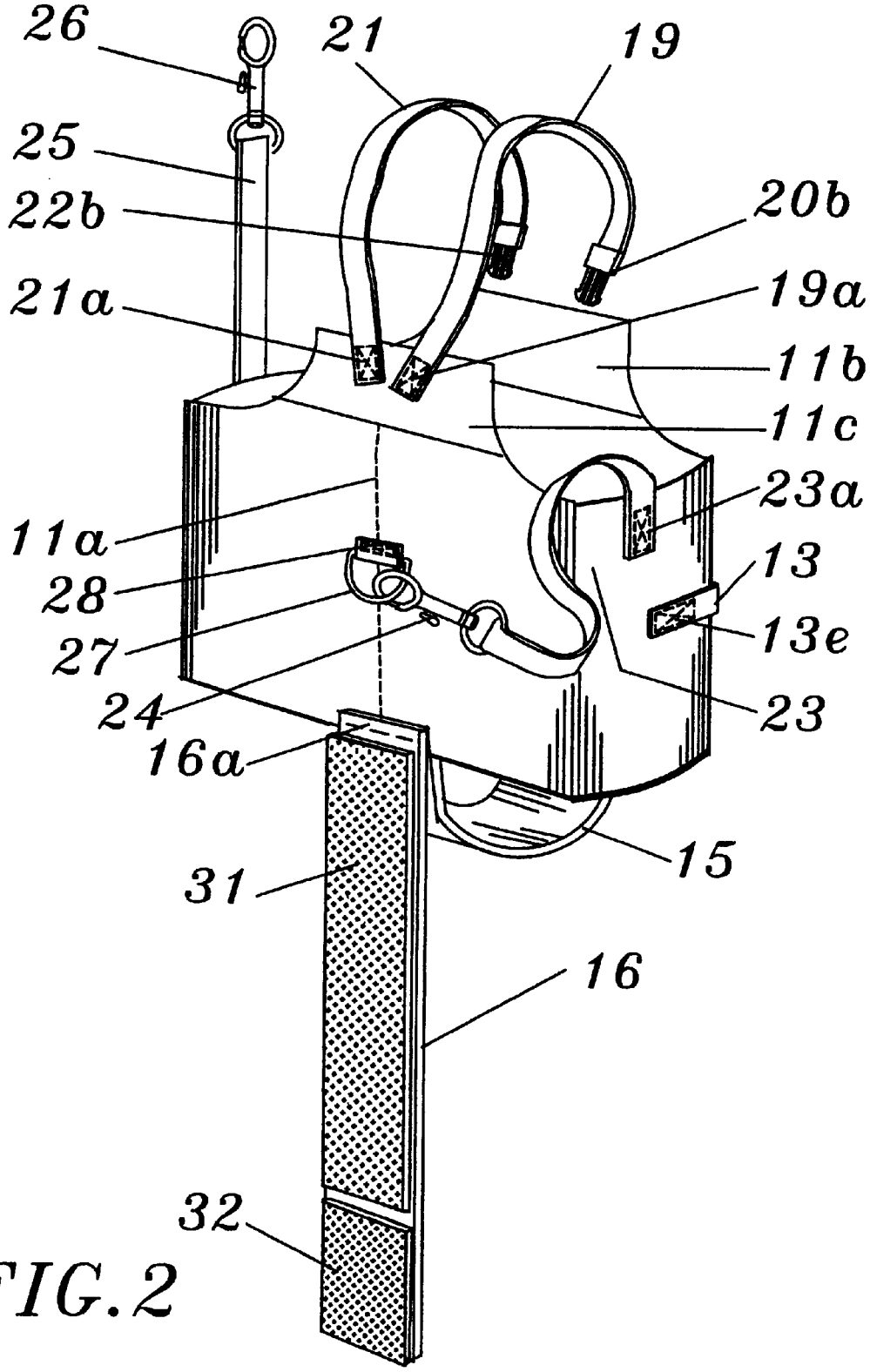
FIG. 2 is an angled prospective rear and right side view of the multi-purpose child safety harness with the right securing strap stowed.

10. Multi-purpose safety harness.
11. Circular band.
11*a*. Seam.
11*b*. Bib portion.
11*c*. Shoulder blade portion.
12. Pocket.
13. Right belt strap.
13*a*. Male portion of a quick release buckle assembly.
13*b*. Female portion of a quick release buckle assembly.
13*c*. Left belt strap.
13*d*. Stitching pattern.
13*e*. Stitching pattern.
14. Loop buckle.
15. Inner crotch strap.

16. Outer crotch strap.
16*a*. Stitching pattern.
17. Hold down loop.
19. Right shoulder strap.
19*a*. Stitching pattern.
20*a*. Female portion of a quick release buckle assembly.
20*b*. Male portion of a quick release buckle assembly.
20*c*. Hold down loop.
21. Left shoulder strap.
21*a*. Stitching pattern.
22*a*. Female portion of a quick release buckle assembly.
22*b*. Male portion of a quick release buckle assembly.
22*c*. Hold down loop.
23. Right securing strap.
23*a*. Stitching pattern.
24. Quick clip.
25. Left securing strap.
25*a*. Stitching pattern.
26. Quick clip.
27. Stow ring.
28. Hold down loop.
31. Velcro loop patch.
32. Velcro hook patch.
33. Child.
34. Swing vertical support.
35. Swing vertical support link.
36. Swing seat.

SUMMARY

A multi-purpose safety harness for a child comprising a band circumscribed about the torso of a child, a pair of shoulder straps, an inner crotch strap, an outer crotch strap, and a pair of securing straps. The outer crotch strap is affixed at the rear portion of the band and has a free end for passing under a swing seat to detachably engage with the chest portion of the band so as to secure the child to the swing seat. A pair of securing straps are also affixed to the band proximate the underarms of the child, wherein the free ends of the securing straps are terminated with attachment means for securing to swing chains or ropes.

PREFERRED EMBODIMENT—DESCRIPTION

As shown in FIGS. 1–4, the preferred embodiment of the multi-purpose child safety harness 10 is made partly from an elongated panel of duck cloth joined at opposing ends at seam 11*a* to form a circular band 11 that circumscribes the torso of the child from just below the armpits of the child to just above the child's crotch area. In relation to the child wearing the harness, the band consists of a chest portion, a rear portion, a right portion, and a left portion. A bib portion 11*b* is extended from the top of the chest portion and a shoulder blade portion 11*c* is extended from the top of the rear portion. Although the location of the seam 11*a* is not important, for this embodiment, it is located at the mid-vertical line of the rear portion of the band.

A right shoulder strap 19 is sewn onto the top of the shoulder blade portion 11*c* of the band by stitching pattern 19*a*. The opposing end of right shoulder strap 19 is threaded through the male portion 20*b* of a quick release buckle assembly. The female portion 20*a* of the quick release buckle assembly is sewn onto the top of the bib portion 11*b* of the band with hold down loop 20*c*. A left shoulder strap 21 is sewn onto the top of the shoulder blade portion 11*c* of the band by stitching pattern 21*a*. The opposing end of left shoulder strap 21 is threaded through the male portion 22*b* of a quick release buckle assembly. The female portion 22*a* of the quick release buckle assembly is sewn onto the top of the bib portion 11*b* of the band with hold down loop 22*c*. The length of both shoulder straps can be adjusted by sliding the respective male portions of quick release buckle assemblies along each of the respective shoulder straps. Each hold down loop is circular and is formed by joining the opposing ends of an elongated strip, after threading through its respective holding assembly such as a D-ring, and closed by sewing onto the desired location of the harness.

An inner crotch strap 15 is permanently sewn at one end onto the bottom center of the chest portion of the band and the opposing end is permanently sewn onto the bottom center of the rear portion of the band.

With hold down loop 17, loop buckle 14 is sewn onto the bottom center of the chest portion of the band.

One end of outer crotch strap 16 is permanently sewn onto the bottom center of the rear portion of the band with stitching pattern 16*a*. At the opposing end of the outer crotch strap 16, a Velcro hook patch 32 is affixed to the rearmost surface. A mating Velcro loop patch 31 is affixed to the mid-portion of the rearmost surface of outer crotch strap 16.

A right securing strap 23 is sewn onto the top of the right portion of the band with stitching pattern 23*a*. To the opposing end of the right securing strap 23 is secured a quick clip 24. A left securing strap 25 is sewn onto the top of the left portion of the band with stitching pattern 25*a*. To the opposing end of left securing strap 25 is secured a quick clip 26.

A waist belt formed by separate parts is sewn onto the midsection of the band. The waist belt consists of a right belt strap 13, a male portion 13*a* of a quick release buckle assembly, a female portion 13*b* of the quick release buckle assembly, a left belt strap 13*c*. The right belt strap 13 is sewn onto the midsection of the right portion of the band by stitching pattern 13*e*. The opposing end of right belt strap 13 is threaded through the male portion 13*a* of the quick release buckle assembly. The left belt strap 13*c* is sewn onto the midsection of the left portion of the band by stitching pattern 13*d*. The opposing end of left belt strap 13*c* is threaded through the female portion 13*b* of the quick release buckle assembly. The waist area of the harness can be adjusted to fit the various sizes of children by sliding the male portion 13*a* of the buckle assembly along the right belt strap 13.

A stowing ring 27 is sewn onto the center of the rear portion of the band with a hold down loop 28.

A pocket 12 is sewn onto the center of the chest portion of the band 11.

This invention is essentially a garment worn over the outer clothing of the child during various activities. Special sewing and stitching techniques are not necessary for this invention. This entire harness can be produced using conventional sewing methods and stitching patterns employed in producing any conventional garment designed for safety and durability.

PREFERRED EMBODIMENT—OPERATION

Figure 3:
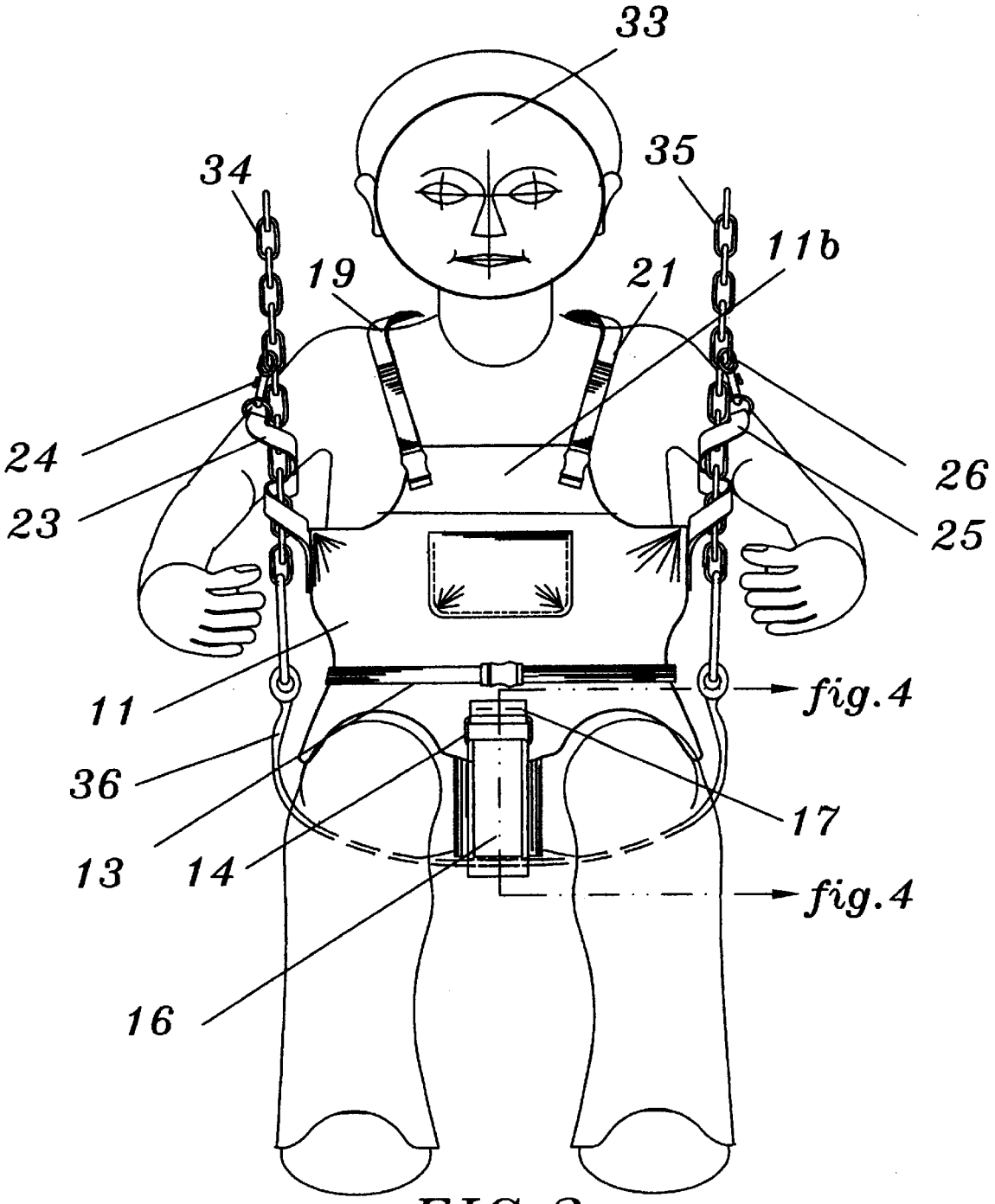
FIG. 3 is a frontal view of an child sitting in a swing, having the harness of the present invention in place and in use to restrain, hold, and support the child in a swing.
Figure 4:
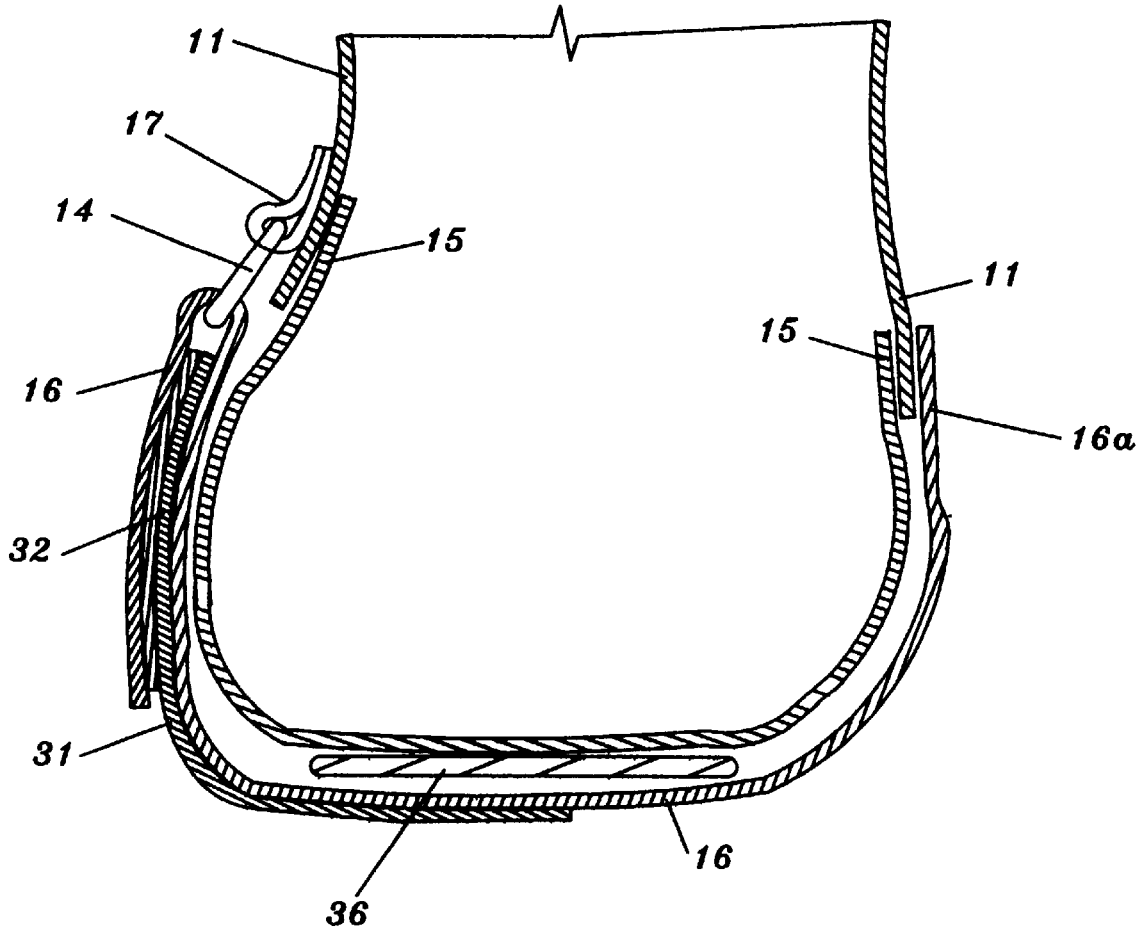
FIG. 4 is an enlarged fragmentary sectional view of the harness and swing seat taken along line 4—4 of FIG. 3.

Operation and use of the multi-purpose child safety harness is simple and straightforward. The harness can be worn over the outer garment of the child 33 at all times. As shown in FIG. 3, the legs of a child are parted and passed through the openings at both sides of the inner crotch strap 15. The band 11 is pulled up to surround the torso of the child. The shoulder straps 19 and 21 are then draped over the child's shoulders and secured by engaging the male portions 20*b* and 22*b* of the quick release buckle assemblies with their respective female portions 20*a* and 22*a* of the quick release buckle assemblies. The length of the shoulder straps 19 and 21 can be adjusted to accommodate the size of the child by slideably adjusting the male portions of the quick release assemblies along the shoulder straps. The waist area of the harness can be adjusted further for the size of a child by slideably adjusting the male portion 13*a* of the quick release buckle assembly along belt 13.

When the safety features of the harness are not necessary, the harness can be used to protect the outer garment worn underneath. The right securing strap 23 and the left securing strap 25 can be stowed away by attached the quick clips 24 and 26 to stow ring 27. The outer crotch strap 16 can be stowed away by threading the Velcro hook patch 32 portion of the outer crotch strap through the loop buckle 14 and engaging the Velcro hook patch 32 with the Velcro loop patch 31.

A proximity tether line (not shown) can be attached to stow ring 27, to ensure that the child is within a short distance from the guardian adult. This is highly desirable under some circumstances such as in a crowded location like a shopping mall or an airport or in dangerous areas or in areas with unknown hazards. The distance from the adult is determined by the length of the tether line used (not shown). Any type of tether line with an attachment hooks can be used to attach to stow ring 27.

For protection during swinging, the harness accommodates a standard swing consisting of a fabric, rubber, metal, leather, or plastic strip seat 36 supported by two vertical members 34 and 35. The goal for harness 10 is to anchor the child in a sitting position on the swing seat while providing the child with upper body support, containment, and restraint. The right securing strap 23 and the left securing strap 25 can be used to securely attach harness 10 to the swing vertical support members 34 and 35. Quick clips 24 and 26 can be used to attach through an individual link of a chain link-type vertical support member. If the support member of the swing is a rope type, then the side straps 23 and 25 can be used by looping around the vertical support members and quick clips 24 and 26 can be attached to side straps 23 and 25. The free end of the outer crotch strap 16 is looped under the swing seat 36 and the Velcro hook patch 32 is passed through the loop buckle 14. The Velcro hook patch 32 is then detachably engaged to the mating Velcro loop patch 31 to keep outer crotch strap 16 secured and tight. With outer crotch strap 16 secured under the swing seat, the child wearing harness is anchored on the swing seat and can not slip off. Furthermore, in the event that the child flipped upside down, the shoulder straps 19 and 21 will prevent the child from ejection out the top of the harness. Therefore, the harness 10 provides support for the child in the upright position while holding and restraining the child on the swing seat during the entire swinging arc of the swing activity. Moreover, with no openings in any side, the surrounding nature of the harness band prevents the child from escaping. The addition of the adjustable waist belt provides additional security and comfort.

For other sitting activity such as on a chair or shopping cart, the goal is to restrain a child with some degree of movement for comfort. This goal can be achieved by engaging the securing straps 23 and 25 to the frame portion of any sitting apparatus. For shopping cart, the securing straps 23 and 25 can be attached to the metal frame using quick clips 24 and 26. For any stationary chair, quick clips 24 and 26 can be used to attach to the back of the chair. If available frame is too large, the quick clips 24 and 26 can be used to engage securing straps 23 and 25 together after looping around the frame. If the seat has openings such as a shopping cart, than the outer crotch strap 16 can also be used to further secure the child on the seat in similar fashion as the swing seat.

The various attachment features in harness 10 include a waist belt, stow ring 27, loop buckle 14, securing straps 23 and 25 with quick clips 24 and 26, and outer crotch strap 16. Possible variations and combinations with these features are wide. Harness 10 can be used to secure, support, restrain, and detain a child as long as there is a stationary frame or anchoring feature at the location where the use of harness is desirable.

CONCLUSIONS, RAMIFICATIONS, AND SCOPE

Accordingly, it can be seen that this invention provides multiple child safety application needs within a single harness. Thus, the instant invention eliminates both the extra expenses and the cumbersome nature of having to acquire, possess, maintain, store, transport, and use multiple harnesses.

Although the description above contains many specifics, such specifics should not be construed as limiting the scope of the invention, but are put forth merely to provide illustrations of some of the presently preferred embodiments of this invention. Various other embodiments and ramifications are possible within it's scope. For example, any fabric material can be used to produce this invention such as cotton, nylon, polyester, denim, plastics, leather, and anything that can be used to make garments or safety harnesses. Manufacturing of the harness can be accomplished by the application of conventional sewing, bonding or fastening techniques suitable to the material selected for the harness.

Other than the engagement assemblies described for the waist belt, securing straps, shoulder straps, and outer crotch strap, other means can be used for adjustably and detachably engaging parts together including Velcro hook and loop sets, tie members, buttons and buttonholes, snap assemblies, buckle assemblies, or other assorted fastener systems. The belt, for example, may even be elastically adjustable.

Although this invention is designed mainly for a child, a large size harness can be made to accommodate a person of any age or size that requires a safety harness and can even be adaptable for use with pets.

Thus the scope of the invention should be determined by the appended claims and their legal equivalents, rather than by the examples given.

What is claimed is:

1. A multi-purpose safety harness for a child comprising:

(a) a circular band, for circumscribing the torso of said child, and, when placed on said child, has a chest portion, a rear portion, a left portion, and a right portion, (b) a pair of shoulder straps, wherein one end of each said strap is affixed to the top of said rear portion of said band and the opposing end of each said shoulder strap is terminated in a means for removably attaching to the top of said chest portion of said band, (c) an inner crotch strap, wherein one end of said inner crotch strap is affixed to a bottom of said rear portion of said band and an opposing end of said inner crotch strap is affixed to a bottom of said chest portion of said band, (d) an outer crotch strap, wherein one end of said outer crotch strap is affixed to the bottom of said rear portion of said band and the opposing end of said outer crotch strap is free and is terminated in a means for detachably engaging to the bottom of said chest portion of said band, (e) a right securing strap, wherein one end of said right securing strap is attached to the top of said right portion of said band and the opposing end of said right securing strap is terminated in a means for attaching to a securing apparatus, and (f) a left securing strap, wherein one end of said left securing strap is attached to the top of said left portion of said band and the opposing end of said left securing strap is terminated in a means for attaching to a securing apparatus.

2. A multi-purpose safety harness for a child as defined in claim 1, further including a stowing ring affixed proximate the center of said rear portion of said band.

3. A multi-purpose safety harness for a child as defined in claim 1, wherein said attaching means for each of said securing straps is a quick clip.

4. A multi-purpose safety harness for a child as defined in claim 1, wherein said means for removably attaching each of said shoulder straps is a quick release buckle assembly.

5. A multi-purpose safety harness for a child as defined in claim 1, wherein said outer crotch strap detachably engaging means comprises:

(a) a hook patch affixed to the rearmost surface proximate the free end of said outer crotch strap, (b) a mating loop patch affixed to the rearmost surface of the mid-portion of said outer crotch strap adjacent to said hook patch, and (c) a loop buckle affixed to the bottom of said chest portion of said band, whereby said free end of said outer crotch strap can pass through said loop buckle for folding back to engage said hook patch to said loop patch.

6. A multi-purpose safety harness for a child as defined in claim 1, further including a waist belt, wherein one end of said waist belt is affixed to the midsection of said left portion of said band and the opposing end of said belt is affixed to the midsection of said right portion of said band, and intermediate on said waist belt is a means for adjusting the length of said waist belt.

7. A multi-purpose safety harness for a child as defined in claim 6, wherein said waist belt adjusting means is a quick release buckle assembly.

8. A multi-purpose safety harness for a child comprising:

(a) a circular band, for circumscribing the torso of said child, and, when placed on said child, has a chest portion, a rear portion, a left portion, and a right portion, (b) a bib portion, wherein said bib portion is attached to the top of said chest portion, (c) a shoulder blade portion, wherein said shoulder blade portion is attached to the top of said rear portion of said band, (d) a pair of shoulder straps, wherein one end of each said strap is affixed to the top of said shoulder blade portion of said band and the opposing end of each said shoulder strap is terminated in a means for removably attaching to the top of said bib portion of said band, (e) an inner crotch strap, wherein one end of said inner crotch strap is affixed to the bottom of said rear portion of said band and the opposing end of said inner crotch strap is affixed to the bottom of said chest portion of said band, (f) an outer crotch strap, wherein one end of said outer crotch strap is affixed to the bottom of said rear portion of said band and the opposing end of said outer crotch strap is few and is terminated in a means for detachably engaging to the bottom of said chest portion of said band, (g) a right securing strap, wherein one end of said right securing strap is attached to the top of said right portion of said band and the opposing end of said right securing strap is terminated in a means for attaching to a securing apparatus, and (h) a left securing strap, wherein one end of said left securing strap is attached to the top of said left portion of said band and the opposing end of said left securing strap is terminated in a means for attaching to a securing apparatus.

9. A multi-purpose safety harness for a child as defined in claim 8, further including a stowing ring affixed proximate the center of said rear portion of said band.

10. A multi-purpose safety harness for a child as defined in claim 8, wherein said attaching means for each of said securing straps is a quick clip.

11. A multi-purpose safety harness for a child as defined in claim 8, wherein said means for removably attaching each of said shoulder straps is a quick release buckle assembly.

12. A multi-purpose safety harness for a child as defined in claim 8, wherein said outer crotch strap engaging means comprises:

(a) a hook patch affixed to the rearmost surface proximate the free end of said outer crotch strap, (b) a mating loop patch affixed to the rearmost surface of the mid-portion of said outer crotch strap adjacent to said hook patch, and (c) a loop buckle affixed to the bottom of said chest portion of said band, whereby said free end of said outer crotch strap can pass through said loop buckle for folding back to engage said hook patch to said loop patch.

13. A multi-purpose safety harness for a child as defined in claim 8, further including a waist belt, wherein one end of said waist belt is affixed to the midsection of said left portion of said band and the opposing end of said belt is affixed to the midsection of said right portion of said band, and intermediate on said waist belt is a means for adjusting the length of said waist belt.

14. A multi-purpose safety harness for a child as defined in claim 13, wherein said waist belt adjusting means is a quick release buckle assembly.

15. A multi-purpose safety harness for a child as defined in claim 8, further including a storage pocket affixed onto said chest portion of said band.

16. A multi-purpose safety harness for a child as defined in claim 8, further comprising:

(a) the means for attaching each of said securing straps is a quick clip, (b) a stowing ring affixed proximate the center of said rear portion of said band, wherein each of said securing straps can be secured to said stowing ring by engaging said quick clips to said stowing ring, (c) the means for removably attaching each of said shoulder straps is a quick release buckle assembly, (d) a waist belt, wherein one end of said waist belt is affixed to the midsection of said left portion of said band and the opposing end of said belt is affixed to the midsection of said right portion of said band, and intermediate on said waist belt is a quick release buckle assembly for adjusting the length of said waist belt, (e) the means for detachably engaging said outer crotch strap is a hook patch affixed proximate the fee end of the rearmost surface of said outer crotch strap, a mating loop patch affixed to the mid-portion of the rearmost surface adjacent to said hook patch, and a loop buckle affixed to the bottom of said chest portion of said band, whereby said free end of said outer crotch strap can pass through said loop buckle for folding back to engage said hook patch to said loop patch, and (f) a storage pocket affixed onto said chest portion of said band.

17. A multi-purpose safety harness for a child as defined in claim 16, wherein said waist belt is made with elastic stretchable material so that said waist belt will automatically flexibly expand and contract to snuggably fit the size of the wearer of said harness.

* * * * *